US008746231B2

(12) United States Patent
Kellogg et al.

(10) Patent No.: US 8,746,231 B2
(45) Date of Patent: Jun. 10, 2014

(54) RANGE EXHAUST CLEANING SYSTEM AND METHOD

(71) Applicant: KBS Automist, LLC, Walker, MN (US)

(72) Inventors: David Alan Kellogg, Walker, MN (US); David Paul Smieja, Hackensack, MN (US); Ryan Dietrich Bruns, Walker, MN (US)

(73) Assignee: KBS Automist, LLC, Walker, MN (US)

( * ) Notice: Subject to any disclaimer, the term of this patent is extended or adjusted under 35 U.S.C. 154(b) by 0 days.

(21) Appl. No.: 13/684,935

(22) Filed: Nov. 26, 2012

(65) Prior Publication Data

US 2013/0074823 A1 Mar. 28, 2013

Related U.S. Application Data

(63) Continuation-in-part of application No. 12/944,599, filed on Nov. 11, 2010, now Pat. No. 8,316,839, which is a continuation of application No. 11/373,474, filed on Mar. 10, 2006, now Pat. No. 7,832,391.

(51) Int. Cl.
*F24C 15/20* (2006.01)

(52) U.S. Cl.
USPC ..... 126/299 E; 126/299 R; 134/166 C; 134/198; 134/199; 169/55; 169/65; 454/49; 454/53; 454/54; 454/55

(58) Field of Classification Search
USPC ..... 126/299 R, 299 E; 134/166 C, 198, 199
See application file for complete search history.

(56) References Cited

U.S. PATENT DOCUMENTS 2,137,862 A * 11/1938 Steins ..... 454/67
2,334,826 A * 11/1943 Lowe ..... 169/17
2,532,420 A * 12/1950 Pledger ..... 126/299 D
2,539,344 A 1/1951 Carraway (Continued)

FOREIGN PATENT DOCUMENTS

AU 2004201371 A1 11/2004
EP 1175173 1/2002

(Continued)

OTHER PUBLICATIONS

Machine Translation to English of FR 2865419 A1 dated Dec. 1, 2013.*

(Continued)

*Primary Examiner* — Jorge Pereiro
(74) *Attorney, Agent, or Firm* — Krenz Hoff, LLP

(57) ABSTRACT

A cleaning system for a cooking range exhaust having a range hood, a backsplash, and an exhaust flue for exhausting cooking effluent is disclosed. The cleaning system can include a fluid delivery system constructed for partial placement within the cooking range exhaust. The fluid delivery system can include a hood spray conduit constructed for placement within the hood and comprising spray openings for directing a degreasing composition to the backsplash. The fluid delivery system can also include a flue spray conduit constructed for placement within or outside the exhaust flue and comprising at least one spray opening for directing the degreasing composition to an interior surface of the flue. The cleaning system can include a pump system constructed for conveying the degreasing composition from a degreasing composition source and through the fluid delivery system. A method of cleaning a cooking range exhaust and a self-cleaning exhaust system are also disclosed.

12 Claims, 12 Drawing Sheets

(56) References Cited

U.S. PATENT DOCUMENTS

| | | | | | |
|---|---|---|---|---|---|
| 2,813,477 | A | | 11/1957 | Gaylord | |
| 2,992,414 | A | | 7/1961 | Viehe | |
| 3,055,285 | A | | 9/1962 | Gaylord | |
| 3,207,058 | A | | 9/1965 | Gaylord | |
| 3,211,080 | A | * | 10/1965 | Rader | 454/16 |
| 3,217,629 | A | * | 11/1965 | Ekern | 126/299 D |
| 3,242,652 | A | | 3/1966 | Malenchini | |
| 3,283,827 | A | * | 11/1966 | Diehl | 169/65 |
| 3,324,629 | A | | 6/1967 | Graswich et al. | |
| 3,381,679 | A | | 5/1968 | Gonzalez | |
| 3,410,195 | A | * | 11/1968 | King | 126/299 E |
| 3,433,146 | A | | 3/1969 | Russell | |
| 3,448,808 | A | | 6/1969 | William et al. | |
| 3,463,233 | A | | 8/1969 | Walter | |
| 3,490,206 | A | | 1/1970 | De Witt | |
| 3,539,153 | A | | 11/1970 | Allan et al. | |
| 3,564,989 | A | | 2/1971 | Williams | |
| 3,589,609 | A | | 6/1971 | Wyant et al. | |
| 3,602,865 | A | | 8/1971 | Milligan | |
| 3,616,744 | A | | 11/1971 | Jensen | |
| 3,628,311 | A | | 12/1971 | Costarella et al. | |
| 3,640,793 | A | | 2/1972 | Scott | |
| 3,653,179 | A | | 4/1972 | Doane | |
| 3,653,443 | A | | 4/1972 | Dockery | |
| 3,667,371 | A | | 6/1972 | Russell | |
| 3,731,462 | A | | 5/1973 | Costarella et al. | |
| 3,745,939 | A | * | 7/1973 | Allbritton | 110/212 |
| 3,782,303 | A | * | 1/1974 | Pfister et al. | 110/162 |
| 3,786,739 | A | | 1/1974 | Wright | |
| 3,795,181 | A | | 3/1974 | Lawson | |
| 3,824,374 | A | | 7/1974 | Mayher | |
| 3,893,831 | A | | 7/1975 | Doane | |
| 3,907,525 | A | | 9/1975 | King | |
| 4,011,101 | A | | 3/1977 | Levenback et al. | |
| 4,022,118 | A | | 5/1977 | Vandas | |
| 4,031,910 | A | | 6/1977 | Lawson | |
| 4,043,320 | A | | 8/1977 | Strew | |
| 4,066,064 | A | | 1/1978 | Vandas | |
| 4,084,947 | A | | 4/1978 | Ear | |
| 4,085,735 | A | | 4/1978 | Kaufman et al. | |
| 4,103,676 | A | | 8/1978 | Kastner | |
| 4,186,727 | A | | 2/1980 | Kaufman et al. | |
| 4,231,769 | A | | 11/1980 | Ahlrich | |
| 4,250,868 | A | * | 2/1981 | Frye | 126/502 |
| 4,259,945 | A | | 4/1981 | Lawson | |
| 4,467,782 | A | * | 8/1984 | Russell | 126/299 D |
| 4,524,835 | A | | 6/1985 | Mingrone | |
| 4,539,024 | A | | 9/1985 | Stehning et al. | |
| 4,784,114 | A | | 11/1988 | Muckler et al. | |
| 4,822,385 | A | | 4/1989 | Strege et al. | |
| 4,834,188 | A | | 5/1989 | Silverman | |
| 4,990,167 | A | | 2/1991 | Stehning | |
| 5,025,361 | A | | 6/1991 | Pitman et al. | |
| 5,038,807 | A | | 8/1991 | Bailey et al. | |
| 5,042,457 | A | | 8/1991 | Gallagher | |
| 5,127,479 | A | | 7/1992 | Stehling et al. | |
| 5,158,429 | A | | 10/1992 | Chiang et al. | |
| 5,235,963 | A | | 8/1993 | Strause | |
| 5,257,171 | A | | 10/1993 | Hara | |
| 5,323,762 | A | | 6/1994 | Chiang | |
| 5,359,990 | A | | 11/1994 | Hsu | |
| 5,429,116 | A | | 7/1995 | Brown | |
| 5,472,342 | A | | 12/1995 | Welsh, II et al. | |
| 5,540,214 | A | | 7/1996 | Boudreault | |
| 5,642,784 | A | | 7/1997 | Guay et al. | |
| 5,662,097 | A | | 9/1997 | Panos | |
| 5,697,839 | A | | 12/1997 | Chen et al. | |
| 5,860,412 | A | | 1/1999 | Way | |
| 5,874,292 | A | | 2/1999 | McMinn, Jr. | |
| 5,960,804 | A | | 10/1999 | Cooper et al. | |
| 5,975,075 | A | | 11/1999 | Ide | |
| 6,029,751 | A | | 2/2000 | Ford et al. | |
| 6,125,841 | A | | 10/2000 | Boudreault | |
| 6,170,480 | B1 | | 1/2001 | Melink et al. | |
| 6,173,791 | B1 | | 1/2001 | Yen | |
| 6,223,741 | B1 | | 5/2001 | Panos | |
| 6,274,375 | B1 | | 8/2001 | McMinn, Jr. et al. | |
| 6,357,459 | B1 | | 3/2002 | Loughmiller | |
| 6,450,874 | B2 | * | 9/2002 | Hoyez et al. | 454/16 |
| 6,457,481 | B1 | | 10/2002 | Tarala | |
| 6,532,972 | B2 | | 3/2003 | Tarala | |
| 6,655,393 | B2 | | 12/2003 | Loughmiller | |
| 6,662,800 | B2 | | 12/2003 | Yeung | |
| 6,712,068 | B1 | | 3/2004 | Yeung | |
| 6,802,310 | B1 | | 10/2004 | Yeung | |
| 6,817,356 | B2 | | 11/2004 | Gallagher | |
| 6,848,140 | B2 | | 2/2005 | Cho et al. | |
| 6,851,422 | B2 | | 2/2005 | Yeung | |
| 6,874,497 | B2 | | 4/2005 | Yeung | |
| 6,880,551 | B2 | | 4/2005 | Yeung | |
| 6,895,954 | B2 | | 5/2005 | Swierczyna et al. | |
| 6,895,957 | B2 | | 5/2005 | Yeung | |
| 6,983,628 | B2 | | 1/2006 | Cho | |
| 7,104,263 | B1 | | 9/2006 | Chen | |
| 7,389,827 | B2 | | 6/2008 | Biehl | |
| 7,614,396 | B2 | | 11/2009 | So | |
| 7,832,391 | B2 | | 11/2010 | Kellogg et al. | |
| 8,316,839 | B2 | | 11/2012 | Kellogg et al. | |
| 2002/0019211 | A1 | * | 2/2002 | Hoyez et al. | 454/16 |
| 2002/0026673 | A1 | | 3/2002 | Cho | |
| 2002/0028501 | A1 | | 3/2002 | McMinn, Jr. | |
| 2003/0037782 | A1 | | 2/2003 | Yeung | |
| 2003/0192529 | A1 | | 10/2003 | Yeung | |
| 2004/0045544 | A1 | | 3/2004 | Yeung | |
| 2004/0055592 | A1 | | 3/2004 | Yeung | |
| 2004/0237958 | A1 | | 12/2004 | Yeung | |
| 2005/0016523 | A1 | | 1/2005 | Yeung | |
| 2005/0081842 | A1 | | 4/2005 | Yeung | |
| 2005/0087069 | A1 | | 4/2005 | Entezarian et al. | |
| 2005/0108326 | A1 | | 5/2005 | Tuttle | |
| 2005/0178378 | A1 | | 8/2005 | Marshall et al. | |
| 2005/0247244 | A1 | | 11/2005 | So | |
| 2005/0274398 | A1 | | 12/2005 | Fonville et al. | |
| 2006/0272832 | A1 | | 12/2006 | Biehl | |
| 2007/0044789 | A1 | | 3/2007 | Grieco | |
| 2007/0209655 | A1 | | 9/2007 | Kellogg et al. | |
| 2009/0272372 | A1 | | 11/2009 | Griffin et al. | |
| 2011/0048397 | A1 | | 3/2011 | Kellogg et al. | |

FOREIGN PATENT DOCUMENTS

| | | | | |
|---|---|---|---|---|
| EP | 1464413 | | 10/2004 | |
| FR | 2865419 | A1 * | 7/2005 | B08B 3/02 |
| GB | 2392240 | A | 2/2004 | |
| GB | 2393507 | A | 3/2004 | |
| JP | 5000218 | | 1/1993 | |
| JP | 9189441 | | 7/1997 | |
| JP | 9189440 | | 9/1997 | |
| JP | 10185264 | A2 | 7/1998 | |
| JP | 11063612 | A | 3/1999 | |
| JP | 11063613 | | 3/1999 | |
| JP | 11118220 | | 4/1999 | |
| JP | 2001304213 | | 2/2001 | |
| WO | WO-0049220 | | 8/2000 | |

OTHER PUBLICATIONS

"U.S. Appl. No. 11/373,474, Examiner Interview Summary mailed Sep. 17, 2008", 2 pgs.

"U.S. Appl. No. 11/373,474, Final Office Action mailed Sep. 25, 2009", 14 pgs.

"U.S. Appl. No. 11/373,474, Non-Final Office Action mailed Mar. 4, 2010", 18 pgs.

"U.S. Appl. No. 11/373,474, Non-Final Office Action mailed Mar. 5, 2009", 20 pgs.

"U.S. Appl. No. 11/373,474, Non-Final Office Action mailed Jun. 11, 2008", 21 pgs.

"U.S. Appl. No. 11/373,474, Notice of Allowance mailed Sep. 13, 2010", 4 pgs.

"U.S. Appl. No. 11/373,474, Preliminary Amendment filed Nov. 26, 2007", 9 pgs.

"U.S. Appl. No. 11/373,474, Response filed Jan. 15, 2010 to Final Office Action mailed Sep. 25, 2009", 16 pgs.

(56) References Cited

OTHER PUBLICATIONS

"U.S. Appl. No. 11/373,474, Response filed Mar. 14, 2008 to Restriction Requirement mailed Feb. 22, 2008", 9 pgs.
"U.S. Appl. No. 11/373,474, Response filed Jun. 3, 2009 to Non Final Office Action mailed Mar. 5, 2009", 19 pgs.
"U.S. Appl. No. 11/373,474, Response filed Jun. 29, 2010 to Non Final Office Action mailed Mar. 4, 2010", 11 pgs.
"U.S. Appl. No. 11/373,474, Response filed Sep. 11, 2008 to Non-Final Office Action mailed Jun. 11, 2008", 18 pgs.
"U.S. Appl. No. 11/373,474, Restriction Requirement mailed Feb. 22, 2008", 7 pgs.
"U.S. Appl. No. 11/373,474, Supplemental Notice of Allowability mailed Oct. 14, 2010", 2 pgs.
"U.S. Appl. No. 12/944,599 , Response filed Sep. 9, 2011 to Non Final Office Action mailed Aug. 17, 2011", 9 pgs.
"U.S. Appl. No. 12/944,599, Non Final Office Action Mailed Feb. 6, 2012", 23 pgs.
"U.S. Appl. No. 12/944,599, Non Final Office Action mailed May 11, 2012", 21 pgs.
"U.S. Appl. No. 12/944,599, Non Final Office Action mailed Aug. 17, 2011", 17 pgs.
"U.S. Appl. No. 12/944,599, Non Final Office Action mailed Sep. 11, 2012", 22 pgs.
"U.S. Appl. No. 12/944,599, Notice of Allowance mailed Oct. 4, 2012", 11 pgs.
"U.S. Appl. No. 12/944,599, Response filed May 22, 2012 to Non Final Office Action mailed May 11, 2012", 8 pgs.

* cited by examiner

RANGE EXHAUST CLEANING SYSTEM AND METHOD

CROSS-REFERENCE TO RELATED APPLICATIONS

This application is a continuation-in-part of and claims priority to U.S. patent application Ser. No. 12/944,599 (assigned U.S. Pat. No. 8,316,839), entitled "RANGE EXHAUST CLEANING SYSTEM AND METHOD," filed on Nov. 11, 2010, which is a continuation of and claims priority to U.S. patent application Ser. No. 11/373,474 (now U.S. Pat. No. 7,832,391), entitled "RANGE EXHAUST CLEANING SYSTEM," filed on Mar. 10, 2006, the entire disclosures of which are hereby incorporated by reference.

TECHNICAL FIELD

The present patent document relates to cooking range exhaust cleaning systems and to methods for cleaning a cooking range exhaust.

BACKGROUND

Cooking range exhausts installed in conjunction with cooking ranges generally include a range hood and an exhaust flue, which are used to draw smoke, odor, grease, and other types of cooking effluent away from a cooking surface. In drawing the effluent away from the cooking surface, the grease and other substances can accumulate on interior surfaces of the range hood and exhaust flue. The interior surfaces of the cooking range hood and exhaust flue, when covered in accumulated cooking effluent, can be a significant fire hazard because grease and other highly flammable effluent are retained near a hot cooking surface.

SUMMARY

Due to the significant fire danger involved in cooking below accumulated grease and other cooking effluent in a cooking range exhaust, the interior surfaces of a range hood and exhaust flue should be cleaned regularly. Typically, cooking range exhaust cleaning is performed manually and can be particularly difficult because of the confined and remote areas involved, such as in the exhaust flue and a backsplash in the range hood. For these reasons, restaurants oftentimes opt to clean cooking areas having difficult to reach cooking range exhaust portions at unsafe periodic intervals. Cleaning of these difficult to reach areas can be costly, messy, and can require closure of the kitchen during the cleaning process.

A cleaning system for a cooking range exhaust having a hood, a backsplash, and a flue for exhausting cooking effluent is disclosed. The cleaning system can include a fluid delivery system constructed for at least partial placement within the cooking range exhaust. The fluid delivery system can include a hood spray conduit constructed for placement within the hood and comprising spray openings for directing a degreasing composition to the backsplash. The fluid delivery system can also include a flue spray conduit constructed for placement within or outside the flue and comprising spray openings for directing the degreasing composition to an interior surface of the flue. The cleaning system can include a pump system constructed for conveying the degreasing composition from a degreasing composition source and through the fluid delivery system. The cleaning system can further include a collection reservoir constructed to collect degreasing composition run off from the cooking range exhaust.

Optionally, the degreasing composition run off can be directed to a restaurant's drainage system.

A method of cleaning a cooking range exhaust having a hood, a backsplash, and a flue is also disclosed. The method can include spraying a degreasing composition on the backsplash and an interior surface of the flue, the degreasing composition stored at a degreasing composition source and sprayed by a pump system connected to a fluid delivery system. The method can also include rinsing the backsplash and the interior surface of the flue with water drawn from a water source by the pump system and sprayed via the fluid delivery system.

A self-cleaning exhaust system is further disclosed. The system can include a cooking range exhaust including a hood, a backsplash, and a flue having a flue opening into the hood, wherein the hood is provided in proximity to a cooking area to recover cooking effluent when the cooking range is operated. The system can also include a fluid delivery system mounted on the cooking range exhaust. The fluid delivery system can include a hood spray conduit and a flue spray conduit. The hood spray conduit can be provided within or outside the hood and includes spray openings provided to deliver a degreasing composition to the backsplash. The flue spray conduit can be provided within or outside the flue and includes spray openings to deliver the degreasing composition to an interior surface of the flue. The system can further include a pump system constructed for conveying the degreasing composition from a degreasing composition source and through the fluid delivery system. The system can include a collection reservoir constructed to collect degreasing composition run off from the cooking range exhaust. Optionally, the degreasing composition run off can be directed to a restaurant's drainage system.

To better illustrate the range exhaust cleaning systems and methods disclosed herein, a non-limiting list of embodiments is provided here:

In Embodiment 1, a cleaning system for a cooking range exhaust, including a range hood having a backsplash and optionally an exhaust flue, comprises a fluid delivery system constructed for at least partial placement within the cooking range exhaust and a pump system. The fluid delivery system can include a non-rotating hood spray conduit constructed for placement within the range hood and longitudinally traversing a portion of the backsplash. The hood spray conduit can comprise a plurality of fixed spray openings for directing a degreasing composition to an interior surface of the backsplash. The pump system can be constructed for conveying the degreasing composition from a degreasing composition source and through the fluid delivery system.

In Embodiment 2, the cleaning system of Embodiment 1 is optionally configured such that the fluid delivery system further comprises a non-rotating flue spray conduit constructed for placement within or outside the flue. The flue spray conduit can comprise or couple to a plurality of fixed spray openings for directing the degreasing composition to an interior surface of the flue.

In Embodiment 3, the cleaning system of Embodiment 2 is optionally configured such that the non-rotating flue spray conduit is constructed for placement outside the flue and includes a plurality of segments. Each segment can include an end coupled to another segment or at least one of the plurality of spray openings.

In Embodiment 4, the cleaning system of any one or any combination of Embodiments 2 or 3 is optionally configured such that the non-rotating flue spray conduit is constructed for placement outside of the flue and includes a plurality of openings along a conduit wall. Each opening can couple to at least one of the plurality of spray openings.

In Embodiment 5, the cleaning system of any one or any combination of Embodiments 2-4 is optionally configured such that at least one of the spray openings of the flue spray conduit is configured to vertically spray the degreasing composition into a fan subsystem located vertically above a top end portion of the flue spray conduit.

In Embodiment 6, the cleaning system of any one or any combination of Embodiments 2-5 is optionally configured such that the fluid delivery system further comprises a fan subsystem conduit constructed for placement within a fan subsystem located vertically above a top end portion of the flue spray conduit. The fan subsystem conduit can comprise a plurality of spray openings for directing the degreasing composition to an interior surface of the fan subsystem.

In Embodiment 7, the cleaning system of Embodiment 6 is optionally configured such that the fan subsystem conduit includes a plurality of bends or couplings. Each bend or coupling can form an angle greater than 90 degrees.

In Embodiment 8, the cleaning system of any one or any combination of Embodiments 6 or 7 is optionally configured such that the fan subsystem conduit is fluidly coupled to the flue conduit.

In Embodiment 9, the cleaning system of any one or any combination of Embodiments 1-8 is optionally configured such that the fluid delivery system further comprises a first connection conduit connecting the hood spray conduit to the pump system along a first fluid path, and a second connection conduit connecting the flue spray conduit to the pump system along a second fluid path spaced from the first fluid path.

In Embodiment 10, the cleaning system of any one or any combination of Embodiments 1-9 is optionally configured such that each of the fixed spray openings of the hood spray conduit and the flue spray conduit comprise a non-rotary spray nozzle.

In Embodiment 11, the cleaning system of Embodiment 1 is optionally configured such that the fluid delivery system further comprises a non-rotating flue spray conduit constructed for placement outside the flue and comprising at least one spray opening for directing the degreasing composition to an interior surface of the flue.

In Embodiment 12, the cleaning system of any one or any combination of Embodiments 1-11 is optionally configured such that the hood spray conduit includes a plurality of individually actuatable zones. Each zone can traverse a portion of the backsplash and include at least one fixed spray opening.

In Embodiment 13, the cleaning system of any one or any combination of Embodiments 1-12 optionally further comprises a user-interface integrated with the pump system allowing control and programming of the pump system. The user-interface can include a memory storing a performance history of the pump system.

In Embodiment 14, the cleaning system of any one or any combination of Embodiments 1-13 is combined with a fire prevention system. The fire prevention system can be integrated with the cooking range exhaust or the fluid delivery system and can be configured to detect and extinguish fires in the cooking range exhaust.

In Embodiment 15, the cleaning system of Embodiment 14 is optionally configured such that the fire prevention system uses the fluid delivery system, and wherein the pump system is constructed for conveying, through the fluid delivery system, the degreasing composition from the degreasing composition source and water from a water source.

In Embodiment 16, a method of cleaning a cooking range exhaust, including a range hood having a backsplash and an exhaust flue, comprises storing a degreasing composition; pumping the degreasing composition to a fluid delivery system at least partially positioned in an area of the range hood bounded by one or more exhaust filters and the backsplash; and spraying the degreasing composition on the backsplash and an interior surface portion of the flue using fixed spray openings of the fluid delivery system.

In Embodiment 17, the method of Embodiment 16 is optionally configured such that spraying the degreasing composition on the backsplash includes using a non-rotating hood spray conduit comprising a plurality of individually actuatable zones. Each zone can longitudinally traverse a portion of the backsplash and comprise at least one fixed spray opening for directing the degreasing composition to an interior surface of the backsplash.

In Embodiment 18, the method of Embodiment 17 is optionally configured such that spraying the degreasing composition on the backsplash includes actuating, at a first time, a first zone comprising at least one fixed spray opening directed at a first portion of the backsplash and actuating, at a second later time, a second zone comprising at least one fixed spray opening directed at a second portion of the backsplash.

In Embodiment 19, the method of any one or any combination of Embodiments 16-18 is optionally configured such that spraying the degreasing composition on the interior surface portion of the flue includes using a non-rotating flue spray conduit positioned outside the flue and comprising at least one fixed spray opening for directing the degreasing composition to the interior surface portion of the flue.

In Embodiment 20, the method of Embodiment 19 optionally further comprises spraying the degreasing composition into a fan subsystem located vertically above a top end portion of the flue spray conduit.

In Embodiment 21, the method of Embodiment 20 is optionally configured such that spraying the degreasing composition into the fan subsystem includes using a fan subsystem conduit positioned within the fan subsystem.

In Embodiment 22, the method of any one or any combination of Embodiments 16-21 optionally further comprises programming a time for automatic pumping of the degreasing composition using a user-interface integrated with the pump system.

In Embodiment 23, the method of any one or any combination of Embodiments 16-22 optionally further comprises storing a record of degreasing cycles performed within a time period.

In Embodiment 24, the method of any one or any combination of Embodiments 16-23 optionally further comprises detecting and extinguishing fires in the cooking range exhaust using a fire prevention system integrated with the fluid delivery system.

In Embodiment 25, a cleaning system for a cooking range exhaust, including a range hood having a backsplash and an exhaust flue, comprises means for storing a degreasing composition; means for pumping the degreasing composition to a fluid delivery system at least partially positioned in an area of the range hood bounded by one or more exhaust filters and the backsplash; means for spraying the degreasing composition on the backsplash and an interior surface portion of the flue using fixed spray openings of the fluid delivery system; means for spraying the degreasing composition into a fan subsystem located vertically above a top end portion of the exhaust flue; means for programming a time for automatic pumping of the degreasing composition; means for storing a record of degreasing cycles performed with a time period; and means for extinguishing fire in the cooking range exhaust.

In Embodiment 26, the cleaning system or method of any one or any combination of Embodiments 1-25 is optionally configured such that all elements or options recited are available to use or select from.

These and other embodiments and features of the present range exhaust cleaning systems and methods will be set forth in part in the following Detailed Description. This Summary is intended to provide non-limiting embodiments of the present subject matter—it is not intended to provide an exclusive or exhaustive explanation. The Detailed Description below is included to provide further information about the present range exhaust cleaning systems and methods.

BRIEF DESCRIPTION OF THE DRAWINGS

In the drawings, like numerals can be used to describe similar elements throughout the several views. Like numerals having different letter suffixes can be used to represent different views or features of similar elements. The drawings illustrate generally, by way of example, but not by way of limitation, various embodiments discussed in the present document.

DETAILED DESCRIPTION

The present disclosure relates generally to a cleaning system for a cooking range exhaust and a method of using a cleaning system to clean a cooking range exhaust. The disclosure contemplates a cleaning system constructed for use in conjunction with a cooking range exhaust. The cooking range exhaust of the present disclosure generally includes a range hood having a backsplash and an exhaust flue that can be found in proximity to cooking areas in restaurants and other kitchen settings. The cleaning system is generally configured to remove cooking effluent from portions of the cooking range exhaust. The cooking effluent to be removed can include grease, smoke residue, and other contaminants. The cleaning system can use a degreasing composition to remove the cooking effluent. While the invention is being described in the context of a number of preferred embodiments, it will be appreciated that the invention can be used in a wide variety of arrangements and on a variety of cooking range exhaust configurations. The invention can work in conjunction with cooking exhaust systems having straight, angled, or both hood and flue configurations.

Figure 1:
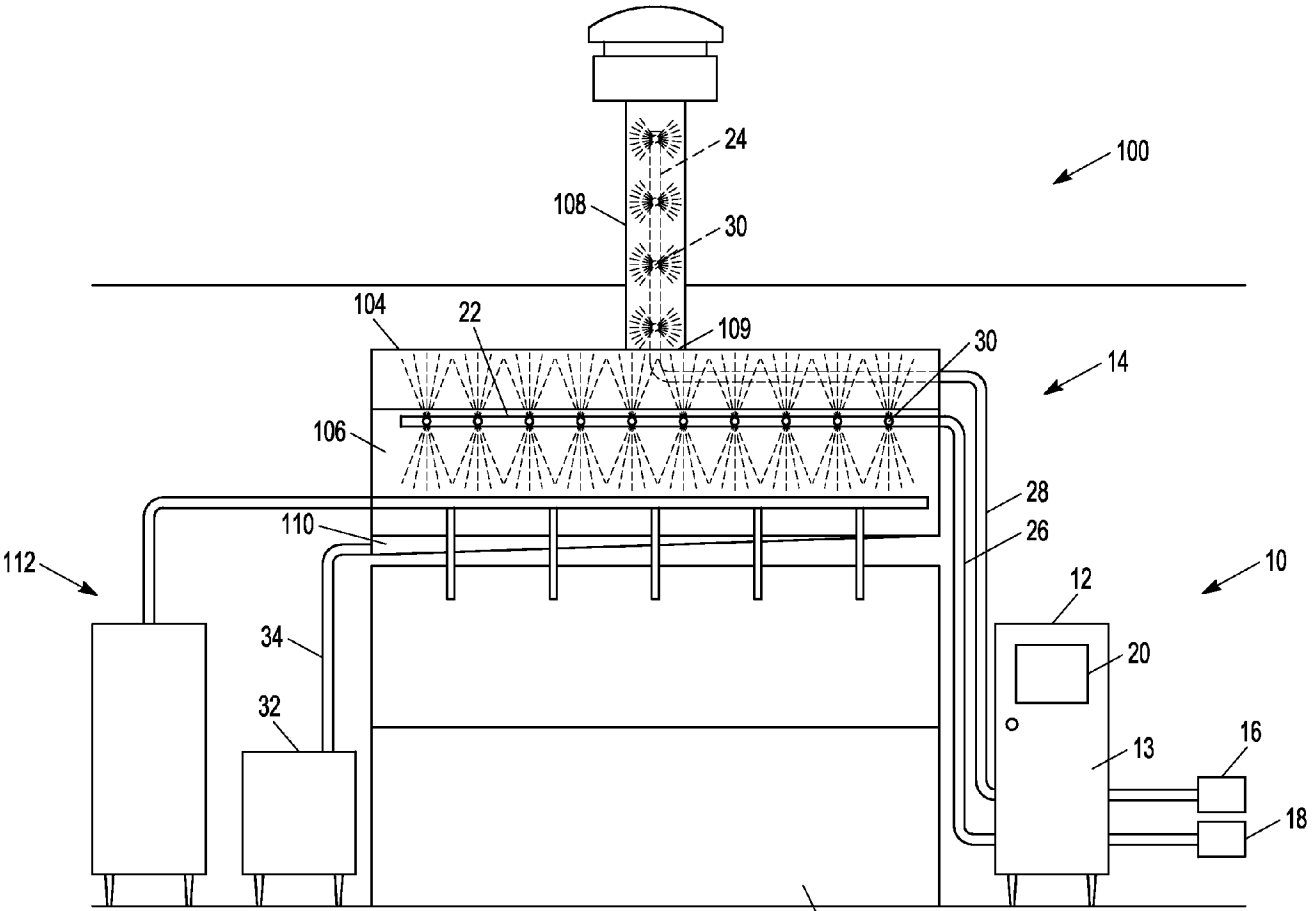
FIG. 1 is a front schematic view of a cleaning system for a cooking range exhaust according to the principles of one embodiment of the present invention.

Referring now to FIG. 1, a front schematic view of a cleaning system 10 for a cooking range exhaust 100 is shown according to an embodiment of the present disclosure. The cooking range exhaust 100 is located in proximity to a cooking area 101. The cooking area 101 can include a range or other cooking or frying appliance. In the embodiment shown, the cooking range exhaust 100 is located above the cooking area 101, and includes a range hood 104, a backsplash 106, an exhaust flue 108, and a grease trough 110. The backsplash 106, as shown, is located within the range hood 104. The exhaust flue 108 can have a flue opening 109 within the range hood 104. A plurality of exhaust filters can reside within the range hood 104 along its entire length, and can be removable for ease of cleaning. One particular exhaust filter adapted for use consistent with the present disclosure is shown below in conjunction with FIGS. 9 and 10.

The cooking range exhaust 100 can include a fire prevention system 112, which can generally be located at least partially within the range hood 104 or the exhaust flue 108. A fire prevention system may be required by state and federal government regulations for safety reasons, and can coexist with the cleaning system 10. It is noted that in certain embodiments of this disclosure, the cleaning system 10 remains separate from the fire prevention system 112; however, it is within the scope of this disclosure that the fire prevention system 112 can be integrated with the cleaning system 10.

In general, the cleaning system 10 can spray a degreasing composition on a backsplash 106 and an interior surface of an exhaust flue 108 of the cooking range exhaust 100. After waiting a predetermined time sufficient for the degreasing composition to react with grease built up on the backsplash 106 and the exhaust flue 108, the cleaning system 10 can optionally spray water on the same surfaces to rinse the cooking range exhaust 100. In some embodiments, the degreasing composition is configured to eliminate any need for subsequent water rinsing.

The degreasing composition used in the present disclosure is largely a matter of choice; however, it is desired that a chemical capable of loosening grease from metal surfaces in hard to reach areas be included in the composition. Exemplary degreasing compositions that can be used include a composition known as LIFT-OFF, available from GreenTree™ by Northland Chemical Corp., and POWER FORCE from Ecolab®.

The cleaning system 10 can include a pump system 12 and a fluid delivery system 14. The pump system 12 can be connected to a water source 16 and a degreasing composition source 18, and can be constructed for conveying a degreasing composition from the degreasing composition source 18 to the fluid delivery system 14. The pump system 12 can also be constructed to convey water from the water source 16 to the fluid delivery system 14. The degreasing composition source 18 can be a degreasing composition reservoir contained in the pump system 12. Alternately, an external connection from the pump system 12 can lead to a degreasing composition source 18. The water source 16 can be a water reservoir contained in the pump system 12, an attachment to a water spigot, or any other water source capable of supplying sufficient water to rinse the degreasing composition from the backsplash 106 or the exhaust flue 108 or be mixed with the degreasing composition prior to application.

The pump system 12 can include a pump 13 that is alternately connected to the degreasing composition source 18 and the water source 16. The pump system 12 can connect the same pump 13 to the degreasing composition source 18 or to the water source 16, such that either degreasing composition, water, or both can be propelled by the pump 13 through the fluid delivery system 14. This connection can be, for example, an electronically timed valve or other fluid control system in the pump system 12.

The pump system 12 can further include a touch screen 20 that can be used to control the pump 13, or access historical records of pump operation (e.g., for insurance recordation purposes). The touch screen 20 can be electrically connected to a microcontroller and memory within the pump system 12 to control pump 13 operation. Alternative control mechanisms, such as switches or buttons, can be used to control the pump 13 as well. Manual controls can also be incorporated into the pump system 12. In some embodiments, the pump system 12 is configured to deliver degreasing composition or water through the fluid delivery system 14 at between 60 pounds per square inch (psi) and 100 psi, such as about 80 psi.

Optionally, the cleaning system 10 can operate without a pump system by leveraging water pressure provided by a city's water system.

The fluid delivery system 14 can include a hood spray conduit 22 constructed for placement within or outside the range hood 104. In the embodiment shown, the hood spray conduit 22 extends within the range hood 104 along substantially the entire length of the backsplash 106. In alternate embodiments, the hood spray conduit 22 can extend less than the entire length of the backsplash 106. The hood spray conduit 22 can be zoned and configured to be individually actuated, such as to clean a particular portion of a range hood, as desired by a user. In an embodiment, the hood spray conduit 22 includes a plurality of individually actuatable zones, with each zone traversing a portion of the backsplash and including at least one fixed spray opening. At a first time, a first zone comprising at least one spray opening can be actuated and used to direct degreasing composition to a first portion of the backsplash. At a second later time, a second zone comprising at least one spray opening can be actuated and used to direct degreasing composition to a second portion of the backsplash.

The fluid delivery system 14 can also include a flue spray conduit 24 constructed for placement within or outside the exhaust flue 108. In the embodiment shown in FIG. 1, the flue spray conduit 24 extends substantially the entire height of the exhaust flue 108 and is placed within the flue 108. In alternate embodiments, such as in the embodiment shown in FIG. 2, the flue spray conduit 24 can extend outside the exhaust flue 108 and can be coupled to spray openings (e.g., spray nozzles) from outside the flue. It is believed that flue spray conduit 24 placements outside exhaust flues 108 having one or more small radius curves or are otherwise hard to internally navigate can be beneficial. As further shown in FIG. 2, the flue spray conduit 24A can include a plurality of segments, with each segment including an end coupled to an adjacent segment or a spray nozzle 30, or the fluid spray conduit 24B can include a plurality of openings along a conduit wall, with each opening coupled to a spray nozzle 30.

Figure 2:
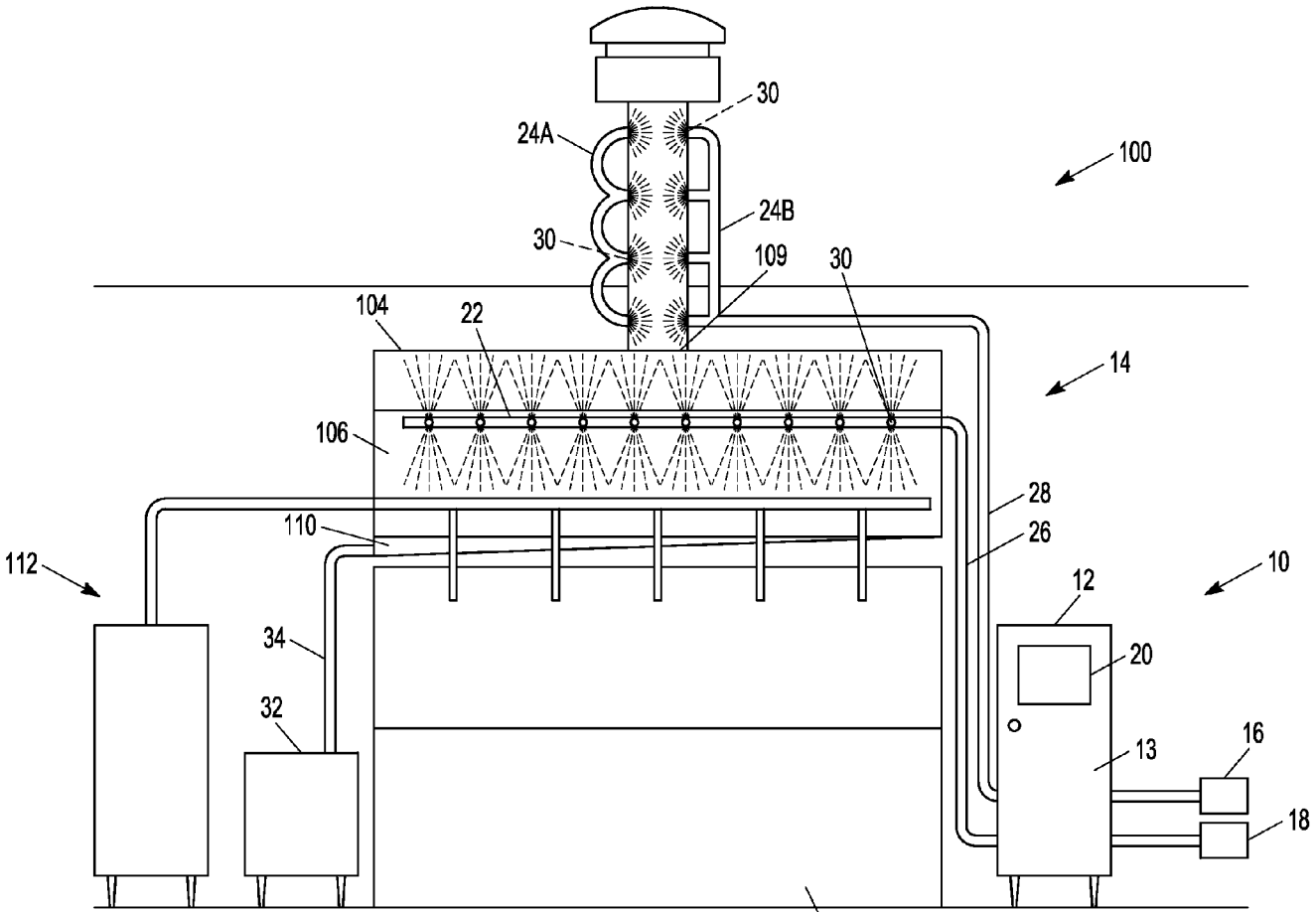
FIG. 2 is a front schematic view of a clean system for a cooking range exhaust according to the principles of an alternative embodiment of the present invention.
Figure 5:
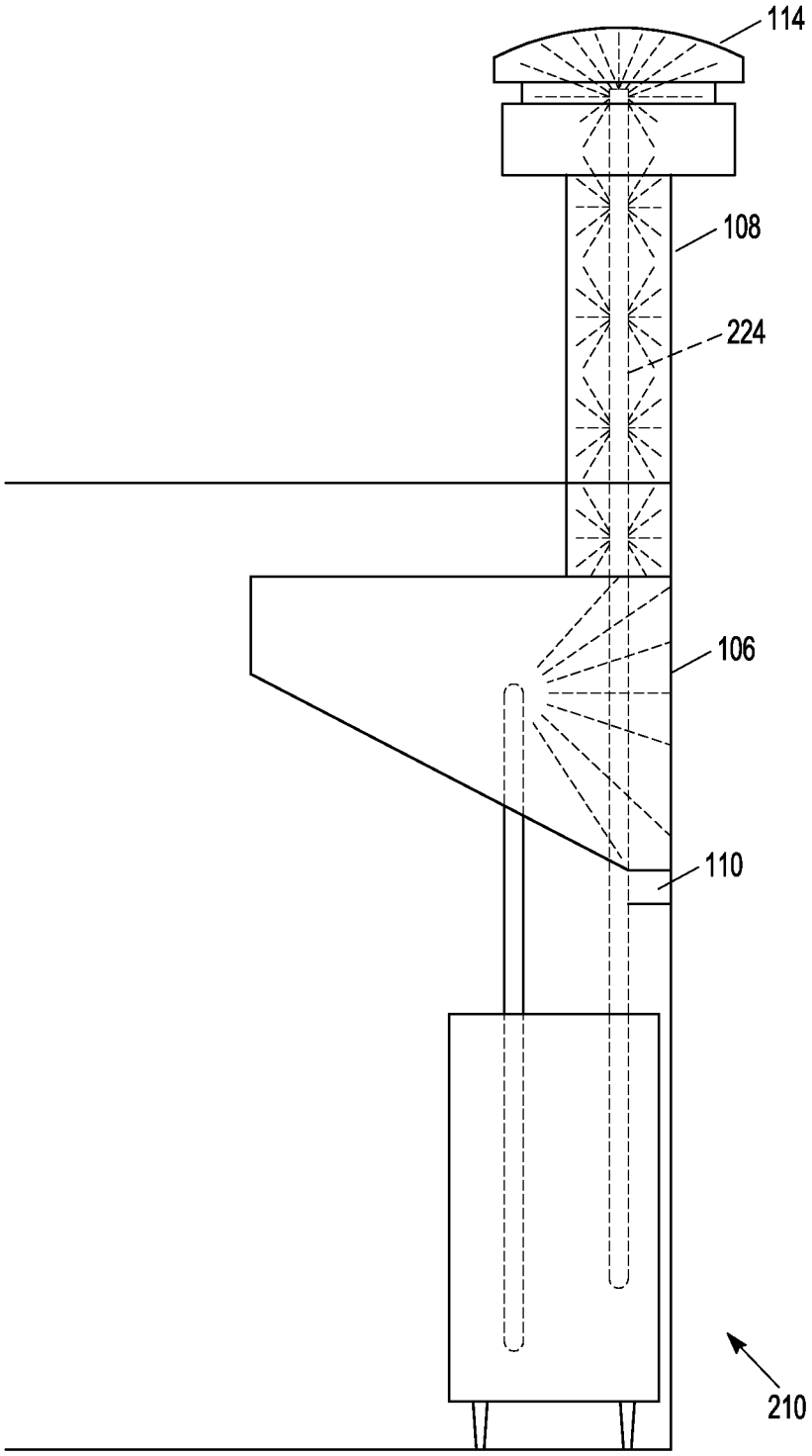
FIG. 5 is a side schematic view of a cleaning system for a cooking range exhaust according to an alternate embodiment of the present invention, including a fluid conduit reaching into a fan subsystem.

The flue spray conduit 24 can be either shorter or longer than shown in FIGS. 1 and 2. For example, the flue spray conduit can extend into a fan subsystem as shown in FIG. 5. The flue spray conduit 24, like the hood spray conduit 22, can be zoned and configured to be individually actuated, such as to clean a particular portion of a flue, as desired by a user.

The hood spray conduit 22 can be connected to the pump system 12 by a first connection conduit 26. Likewise, the flue spray conduit 24 can be connected to the pump system 12 by a second connection conduit 28. In the embodiment shown, the hood spray conduit 22 is integral with the first connection conduit 26, and the flue spray conduit 24 is integral with the second connection conduit 28. By integral, it is intended that the conduits are attached or commonly manufactured from a single conduit.

In an alternate embodiment, the fluid conduits 22, 24 are not integral with their respective connection conduits 26, 28. Rather, the conduits are joined by a junction piece, such as a sleeve or an elbow junction.

Figure 3:
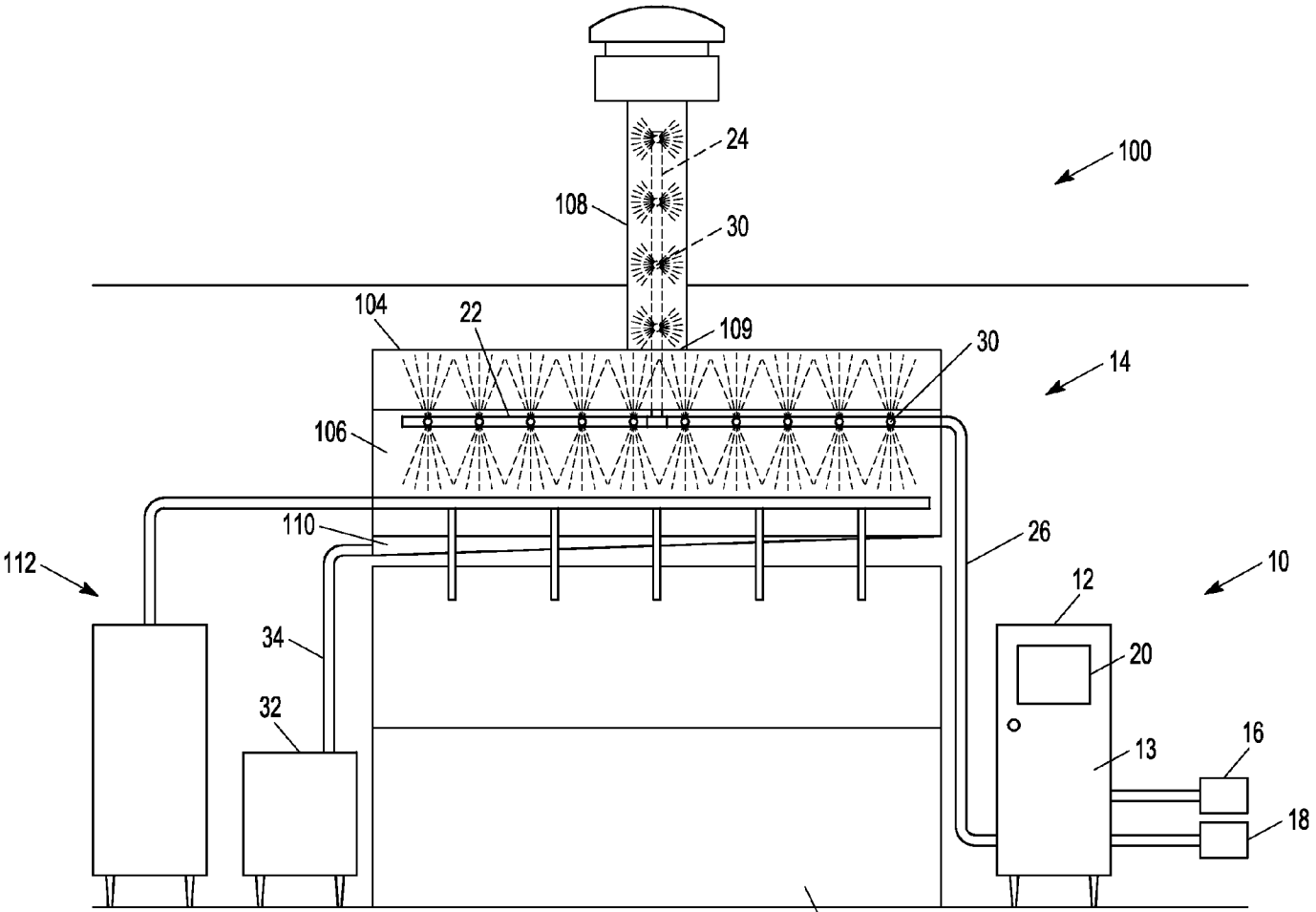
FIG. 3 is a front schematic view of a cleaning system for a cooking range exhaust according to the principles of an alternative embodiment of the present invention.

In alternate embodiments of the present disclosure, the first connection conduit 26 can connect both the hood spray conduit 22 and the flue spray conduit 24 to the pump system 12. In one such embodiment, the flue spray conduit 24 connects to the hood spray conduit 22 within the range hood 104, as shown in FIG. 3.

Both the hood spray conduit 22 and the flue spray conduit 24 can include non-rotating spray openings. The spray openings, shown as the spray nozzles 30, can be spaced along both the hood spray conduit 22 and the flue spray conduit 24 and project a mist or a flat spray pattern, for example. The spray openings spaced along the hood spray conduit 22 can be oriented toward the backsplash 106. The spray openings spaced along the flue spray conduit 24 can be oriented toward an interior surface of the exhaust flue 108. This orientation can allow the spray nozzles 30 in the hood spray conduit 22 and the flue spray conduit 24 to direct the degreasing composition to the backsplash 106 and the exhaust flue 108, respectively. Further configurations of the spray openings beyond spray nozzles 30 are possible. For example, the openings can be holes in the hood and flue spray conduits 22, 24 or can be clusters of spray nozzles.

In various embodiments of the present invention, the fluid delivery system 14 can be formed at least in part from stainless steel pipe. The spray nozzles 30 can be, for example, fitted to or welded over openings in the pipe. Other conduit materials can alternative be used (e.g., PVC piping), and other methods for attaching spray nozzles 30 can be implemented.

The cleaning system 10 can optionally include a collection reservoir 32. The collection reservoir 32 can be constructed to collect degreasing composition run off from the cooking range exhaust 100. Degreasing composition run off can include the degreasing composition, water used to rinse the degreasing composition from the cooking range exhaust, or cooking effluent removed from the cooking range exhaust by the degreasing composition. Additional cooking, degreasing, or rinsing substances can be included in the degreasing composition run off as well.

In the embodiment shown, the range hood 104 includes a drain or grease trough 110. The cleaning system 10 can include a drain pipe 34 leading from the drain trough 110 to the collection reservoir 32, allowing the degreasing composition run off collecting in the drain trough 110 to migrate to the collection reservoir 32 or a restaurant's drainage system. Other configurations of the drain pipe 34 and collection reservoir 34 are possible, such as to accommodate cooking range exhausts having different types of drain troughs.

In use, the cleaning system 10 can be programmed via the touch screen 20 on the pump system 12 to activate at a specific time of day. For example, the cleaning system 10 can be programmed to operate at night after use of the cooking area and range exhaust is completed for the day. At the assigned time, the pump system 12 can activate and can connect the pump 13 to the degreasing composition source 18, for example. The pump system 12 can then force degreasing composition from the degreasing composition source 18, through the fluid delivery system 14, and out spray nozzles 30 spaced along the hood spray conduit 22 or the flue spray conduit 24. The pump system 12 can activate the pump 13 for a sufficient time to spray the degreasing composition onto the backsplash 106 and at least one interior surface of the exhaust flue 108, for example. The pump system 12 can then stop the pump 13, allowing the degreasing composition remaining in the fluid delivery system 14 to drain back through the pump system 12 to the degreasing composition source 18.

The pump system 12 can wait a predetermined time to allow the degreasing composition to sufficiently contact the grease to allow removal of grease and other contaminants from the affected surfaces of the backsplash 106 or exhaust flue 108. For example, the pump system 12 can wait at least three seconds, at least 5 seconds, at least 30 seconds or at least one minute to allow the degreasing composition to sufficiently contact the grease. After sufficient contact, the surface can optionally be rinsed with water. Of course, other predetermined times can be used, and may or may not be programmable in the pump system 12 via the touch screen 20.

The pump system 12 can connect the pump 13 to the water source 16 and force water through the fluid delivery system 14. The water can exit the same spray nozzles 30 as the degreasing composition, and can rinse the degreasing composition from the backsplash 106 or the exhaust flue 108. Once sufficient water is pumped by the pump system 12 to rinse the degreasing composition from those surfaces, the pump system 12 can deactivate the pump 13.

The degreasing composition and optionally the water can drain toward the drain trough 110 of the cooking range exhaust 100. The cleaning system 10 can allow this degreasing composition run off to drain through the drain trough 110, through a drain pipe 34, to a collection reservoir 32 or a drain.

The degreasing and optional rinsing can be repeated by the cleaning system one or more times in succession, for example, to further clean the cooking range exhaust 100.

The pump system 12 of the present disclosure can be configured to only produce suitable force to cause the degreasing composition to mist from the hood spray conduit and the flue spray conduit 24 to reach the backsplash 106 and the exhaust flue 108, respectively. The cleaning system 10 does not require, but does allow, highly-pressurized spray from the spray nozzles 30.

In various embodiments of the present disclosure, the spraying and rinsing steps can be manually or automatically controlled, for example by the pump system as described above. In further embodiments of the present disclosure, the pump system 12 can store a record of the degrease and rinse cycles performed, such that a user or inspector of the cleaning system 10 or insurance carrier of the restaurant can readily determine a frequency and/or number of cleanings performed within a given time period. By way of example, a weekly timer as well as a yearly timer can be used to ensure the cleaning system 10 operates a certain number of times per week or year. It is believed that the incorporation of a weekly or yearly timer may find use in stadium or event center cooking range exhaust locations.

With the cleaning system 10 installed, the cooking range exhaust 100 can be considered a self-cleaning exhaust system, in that cleaning hard-to-reach areas such as the backsplash 106 and the exhaust flue 108 requires limited user involvement. The cleaning system 10 can clean exhaust flues of various shapes, such as circular or rectangular, and can be provided without the use of rotating parts.

Referring now to FIG. 3, a front schematic view of a cleaning system 10 for a cooking range exhaust 100 is shown according to an embodiment of the present disclosure. In this embodiment, the fluid delivery system includes a first connection conduit 26 that connects the hood spray conduit 22 and the flue spray conduit 24 to the pump system 12. The flue spray conduit 24 is connected to the hood spray conduit 22. This configuration of the hood spray conduit 22 and the flue spray conduit 24 can allow the pump system 12 to convey the degreasing composition or water through the fluid delivery system 14 via a single conduit, shown as first connection conduit 26. In an alternate embodiment, the pump system 12 can be directly connected to the hood spray conduit 22 without a connection conduit.

Figure 4:
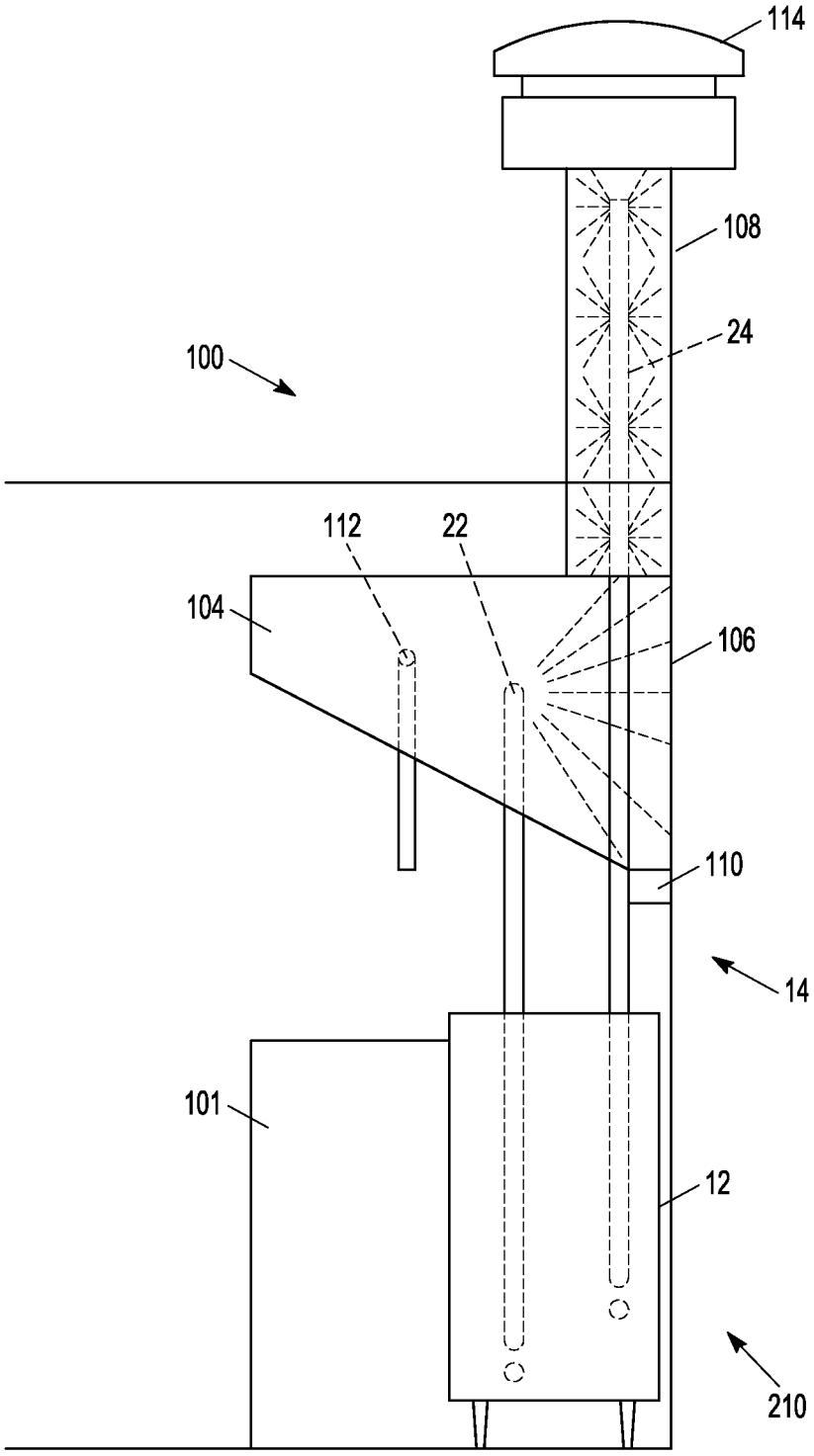
FIG. 4 is a side schematic view of the cleaning system of FIG. 1.

Referring now to FIG. 4, a side schematic view of the cleaning system 10 of FIG. 1 is shown. In the embodiment shown, the pump system 12 resides next to a cooking area 101. The hood spray conduit 22 and first connection conduit 26 are integral, and connect to the pump system 12. Spray openings can be oriented toward the backsplash 106 within the range hood 104. The flue spray conduit 24 and second connection conduit 28 can be integral and connected to the pump system 12 as well, and spray openings on the flue spray conduit 24 can be oriented toward interior surfaces of the exhaust flue 108. At the top of the flue, a fan subsystem 114 is located above a terminating end of the flue spray conduit 24.

Degreasing composition and water draining from the backsplash 106 and the exhaust flue 108 can migrate to the drain trough 110 and away from the cooking range exhaust 100 via the drain pipe and collection reservoir (seen, for example, in FIG. 1). It is noted that in the embodiments shown, the fluid delivery system 14 remains separate from a fire prevention system 112 that can be located at least partially within the range hood 104 and the exhaust flue 108. The fire prevention system 112 may be required by state and federal government regulations for safety reasons, and can coexist with the cleaning system 10. For clarity, the fire prevention system 112 is not included in the remaining figures; however, it is understood to continue to be present in the cooking range exhaust 100.

Referring now to FIG. 5, a side schematic view of a cleaning system 210 for a cooking range exhaust 100 is shown according to an alternate embodiment of the present disclosure. In this embodiment, the flue spray conduit 224 extends into a fan subsystem 114 of the cooking range exhaust 100. At least one of the spray openings is constructed to direct the degreasing composition toward an interior surface of the fan subsystem 114. The flue spray conduit 224 can extend into the fan subsystem 114 regardless of the connection within the range hood 104. In an alternate embodiment, the flue spray conduit 224 can connect to the hood spray conduit, as shown in FIG. 3.

As in FIG. 4, degreasing composition run off and water draining from the backsplash 106, the exhaust flue 108, and the fan subsystem 114 can migrate to the drain trough 110 and away from the cooking range exhaust 100 via the drain pipe and the collection reservoir or drain.

Figure 6:
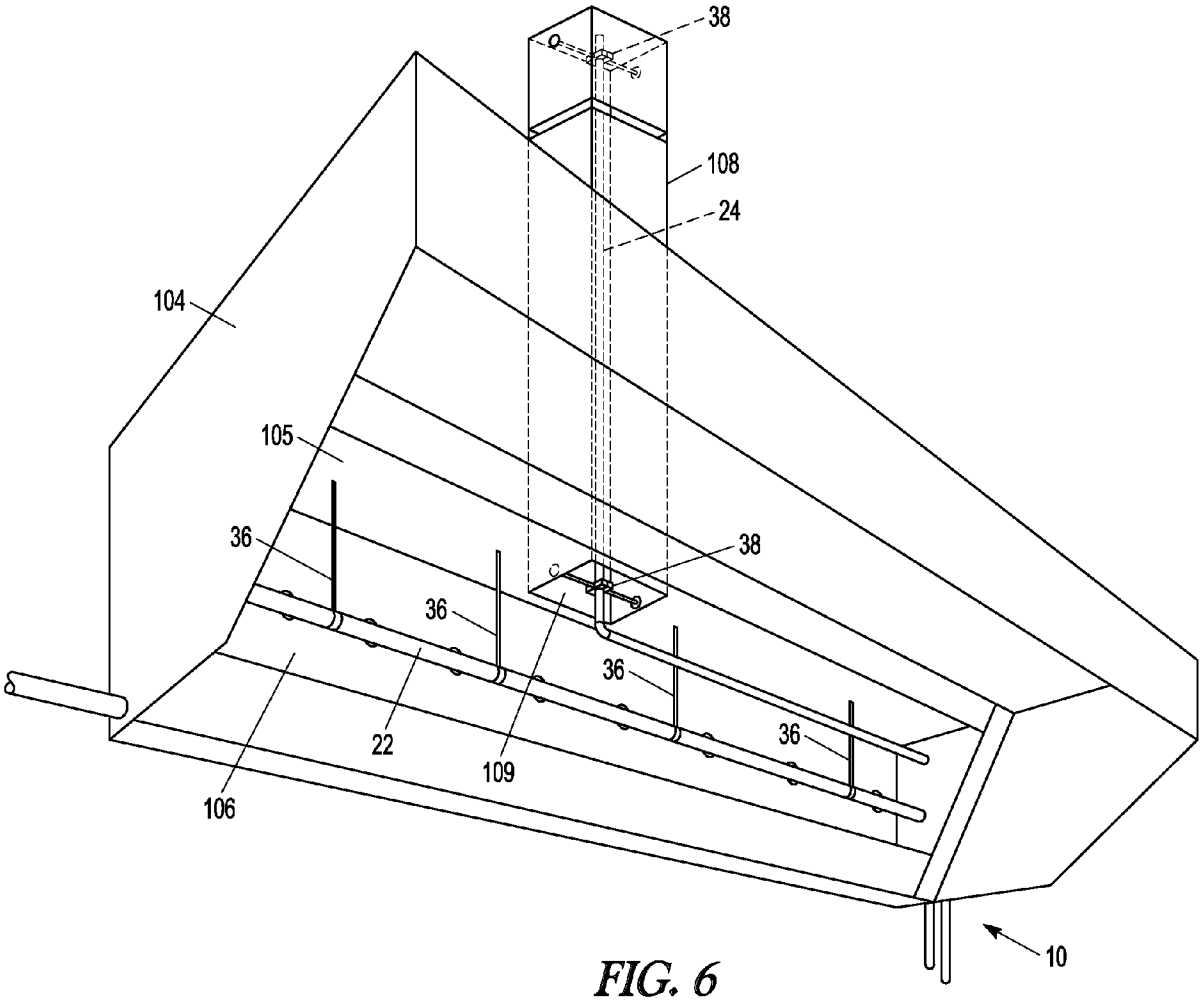
FIG. 6 is a perspective schematic view of a portion of a cleaning system for a cooking range exhaust according to the principles of one embodiment of the present invention.

Referring now to FIG. 6, a perspective schematic view of a portion of a cleaning system 10 is shown according to an embodiment of the present disclosure. In the embodiment shown, a mounting arrangement for the hood spray conduit 22 and the flue spray conduit 24 are shown. The hood spray conduit 22 can be held in a position along the backsplash 106 with mounting brackets 36. The mounting brackets 36 can attach to the range hood 104 at one or more positions. The mounting brackets 36 can extend from a top portion 105 of the range hood 104, such that the hood spray conduit 22 resides approximately halfway down the backsplash 106. The hood spray conduit 22 can be held at a distance from the backsplash 106 sufficient to allow the spray nozzles to propel the degreasing composition and the water to substantially the entire surface of the backsplash 106.

The flue spray conduit 24 can be held within the exhaust flue 108 by at least one mounting clamp 38. In the embodiment shown, two mounting clamps 38 can hold the flue spray conduit 24 substantially centrally within the exhaust flue 108. One of the mounting clamps 38 can be located near the flue opening 109 from the exhaust flue 108 to the range hood 104. In such an embodiment, spray openings (such as the spray nozzles 30 of FIG. 1) are located on all sides of the flue spray conduit 24. In an alternate embodiment of the cleaning system 10 shown, for example in FIG. 3, the flue spray conduit 24 can connect to the hood spray conduit 22, such as below the flue opening 109.

Figure 7:
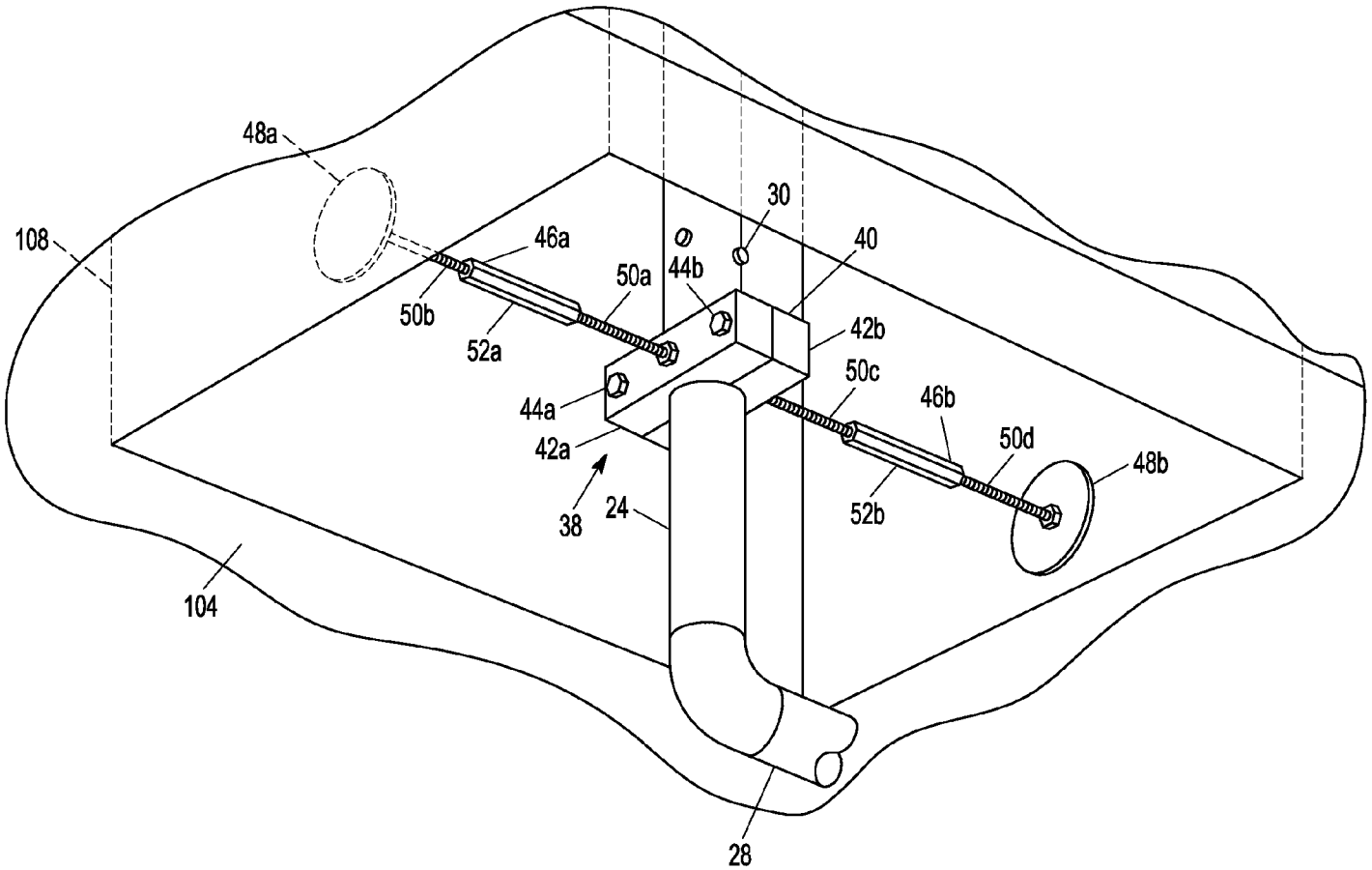
FIG. 7 is a detailed schematic view of a portion of the cleaning system of FIG. 6.

Referring now to FIG. 7, a detailed schematic view of a portion of the cleaning system 10 of FIG. 6 is shown. In the embodiment shown, a mounting clamp 38 is shown holding the flue spray conduit 24 within the exhaust flue 108 at the flue opening 109 of the flue 108 into the range hood 104. In the embodiment shown, the mounting clamp 38 can be located above the junction of the flue spray conduit 24 and the second connection conduit 28, and below the spray nozzles 30. The mounting clamp 38 can include a clamp body 40 surrounding the flue spray conduit 24. The clamp body 40 can be constructed from two opposed segments 42*a*, 42*b* formed around the flue spray conduit 24 and bolted together with bolts 44*a*, 44*b*. Alternative configurations of the clamp body 40 are possible as well.

Two opposed adjustable legs 46*a*, 46*b* can extend from opposite sides of the clamp body 40, and can be terminated at feet 48*a*, 48*b*. Each leg 46 can adjust in length, and can adapt to the size of the exhaust flue 108 in which the flue spray conduit 24 is installed. In the embodiment shown, the legs 46*a*, 46*b* each include two threaded rods 50*a-b*, 50*c-d*, respectively, each leg joined by a threaded spacer 52*a*, 52*b* that allows for such adjustment.

Once installed, friction between the interior walls of the exhaust flue 108 and the feet 48*a*, 48*b* can hold the mounting clamp 38 and the flue spray conduit 24 in the flue 108, eliminating the need for drilling holes or adding mounting screws within the flue 108. In an alternate embodiment, mounting screws or other structure can be used to fix the mounting clamp 38 to the exhaust flue 108.

Figure 8:
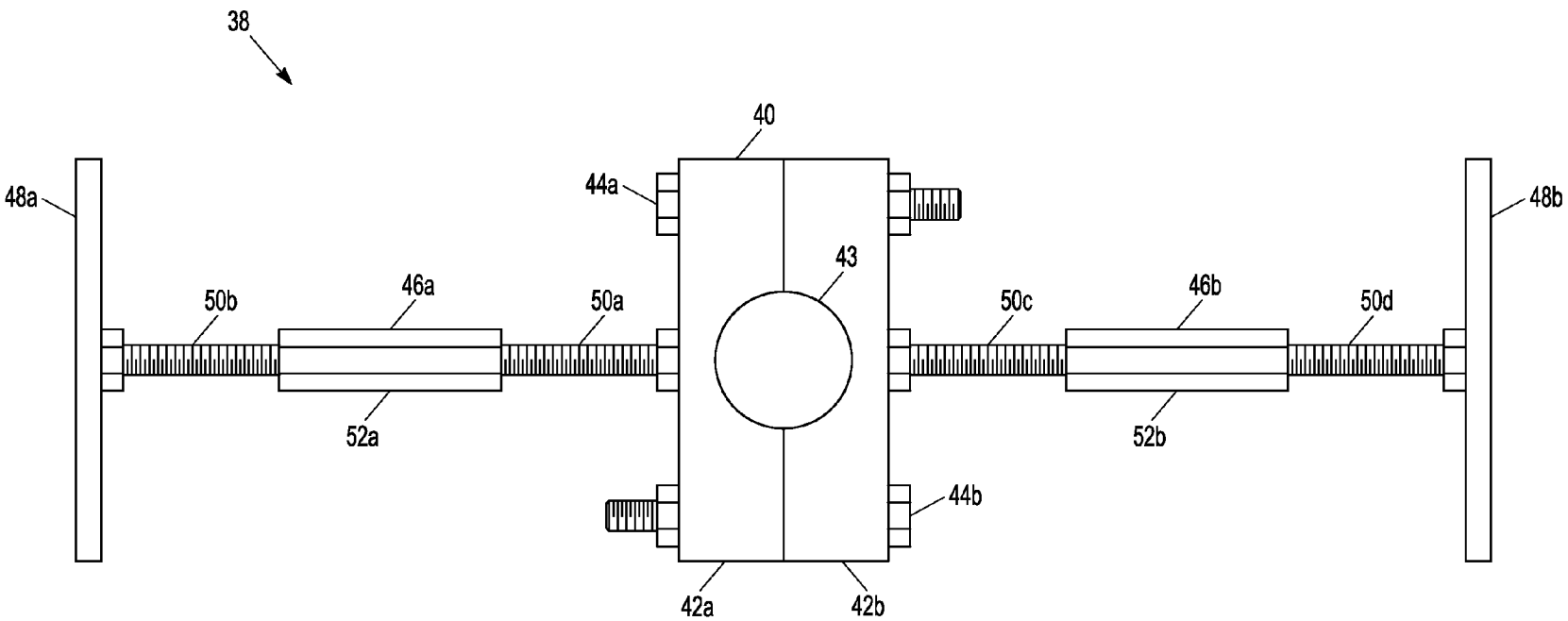
FIG. 8 is a front schematic view of a mounting clamp used to mount portions of the cleaning system within the cooking range exhaust according to the principles of one embodiment of the present invention.

Referring now to FIG. 8, a front schematic view of a mounting clamp 38 used to mount portions of the cleaning system 10 within the exhaust flue 108 is shown according to an embodiment of the present disclosure. In the embodiment shown, the mounting clamp 38 includes a clamp body 40 formed from two opposed segments 42*a*, 42*b*. The opposed segments can be connected with bolts 44*a*, 44*b*, and form an aperture 43 sized to receive the flue spray conduit 24 of FIGS. 1-7. Bolts 44*a*, 44*b* can be fed through holes in the opposed segments 42*a*, 42*b* in opposite directions. Alternately, the bolts 44*a*, 44*b* can be inserted through the opposed segments 42*a*, 42*b* from the same direction.

The mounting clamp 38 can include two opposed adjustable legs 46*a*, 46*b* that extend from opposite sides of the clamp body 40, and are terminated at feet 4Sa, 48*b*. The legs 46*a*, 46*b* can each include threaded rods 50*a-b*, 50*c-d*, respectively, where each leg 46 is joined by a threaded spacer 52*a*, 52*b* that allows for adjustment of the legs to lengthen or shorten the leg accordingly in order to fit within varied sizes of exhaust flues 108.

Feet 48*a*, 48*b* can be screwed or affixed to the end of the legs 44, and act to spread out the force applied to the interior walls of the exhaust flue 108, and to hold the flue spray conduit in place. The feet 48 can be any shape, although in the embodiment shown, disc-shaped feet are used.

Figure 9:
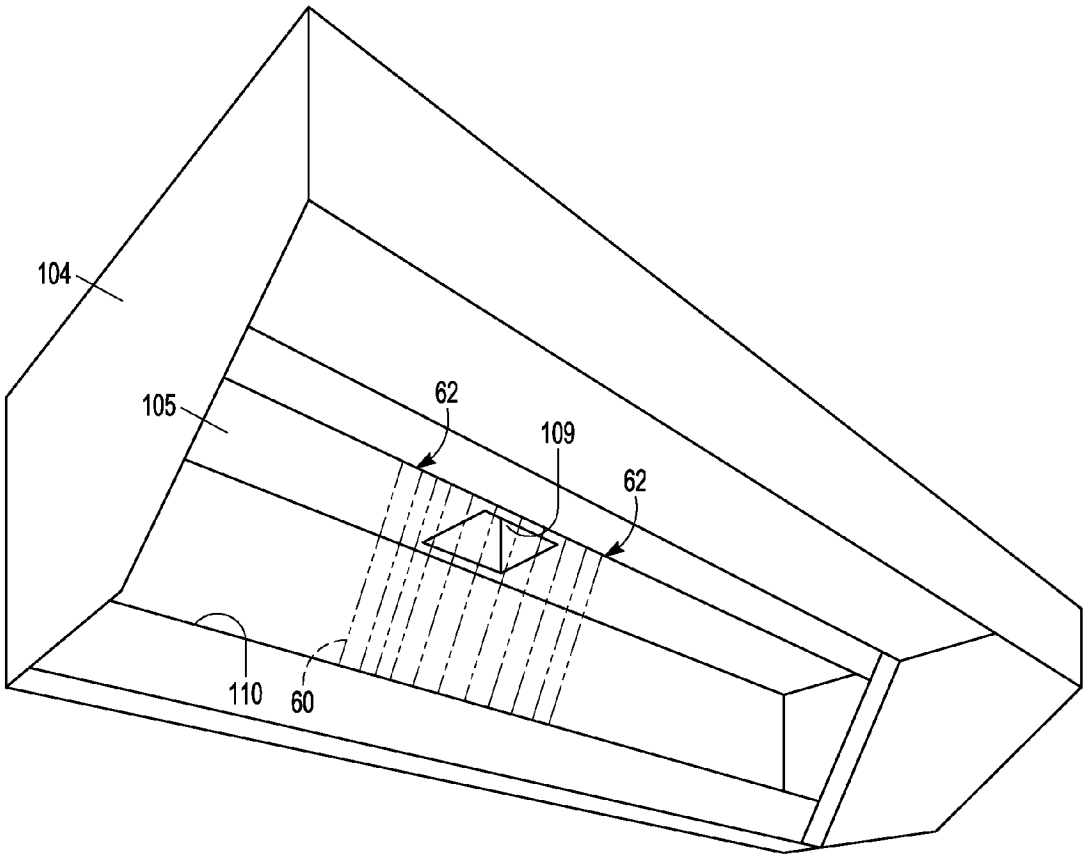
FIG. 9 is a perspective schematic view of a range hood with an exhaust filter according to the principles of one embodiment of the present invention.

Referring now to FIG. 9, a perspective schematic view of the range hood 104 with an exhaust filter 60 installed is shown according to an embodiment of the present disclosure. Standard exhaust filters are typically shorter segments 12 that extend from the top portion 105 of the range hood 104 to the drain trough 110 and are placed side-by-side within the entire length of the range hood 104. The exhaust filters are constructed to catch grease and allow the grease and other contaminants to drain into the drain trough 110. Although these short segments of filters are easily handled, small gaps remain between the filter segments that allow slight drippage of grease back onto the cooking area. This problem can be exacerbated in the location directly under the flue opening 109 due to the increased amount of degreasing composition run off draining out of the exhaust flue 108. Hence, the present disclosure includes the extended exhaust filter 60 in the range hood 104. The exhaust filter 60 can reduce or prevent flow of the degreasing composition run off onto the cooking surface. Alternatively or in conjunction, an overlapping flap can be affixed to one end of an exhaust filter to prevent fluid leakage between adjacent filters or a removable flap can be positioned between the adjacent filters.

The exhaust filter 60 is shown in broken lines installed within the range hood 104. The exhaust filter 60 extends from a top portion 105 of the range hood 104 to the drain trough 110. The exhaust filter 60 is longer than the standard exhaust filters described above, and in the embodiment shown is sized such that it extends at least 15 inches past either edge of the flue opening 109 leading to the flue. This sizing limits the amount of degreasing composition run off dripping from the flue opening 109 and onto the cooking area 101. Other filters of various sizes longer than the flue opening 109 can be used as well.

In one embodiment, the exhaust filter 60 is constructed from two standard sized exhaust filters welded or otherwise fixed together such that no gap is allowed at the center of exhaust filter 60. Additional standard exhaust filters are added to the range hood 104 to fill the remainder of the range hood not below the flue opening 109 to the exhaust flue 108 where exhaust filter 60 resides.

Exhaust filter 60 and the standard exhaust filters residing within the range hood 104 are removable for cleaning. One or more markers 62 can be located on the range hood 104 denoting the proper location of exhaust filter 60 such that a user can readily determine the proper spacing and location to prevent leakage from the exhaust flue 108 onto the cooking area 101. The markers 62 can be painted, etched, or otherwise attached to the range hood 104. In the embodiment shown, two markers 62 denote the proper location of the edges of the exhaust filter 60.

Figure 10:
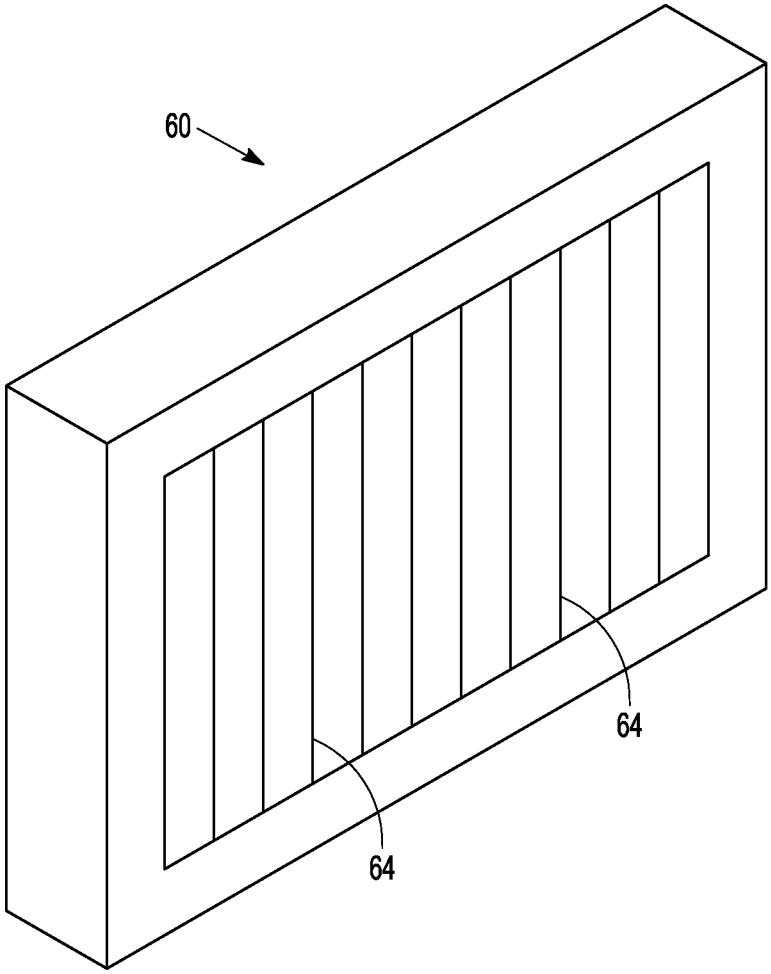
FIG. 10 is a perspective schematic view of an exhaust filter according to the principles of one embodiment of the present invention.

Referring now to FIG. 10, a perspective schematic view of an exhaust filter 60 used to implement aspects of the present disclosure is shown. The exhaust filter 60 can include a series of ridges 64 incorporated into a central area of each side of the filter 60. The ridges can allow ingress of grease, water, and other liquids into the central volume of the filter 60 defined by the length, width, and depth of the filter 60. Drainage holes (not shown) can be located along a bottom edge of the filter 60, and allow the gathered liquid to exit the filter. When the filter 60 is installed in the range hood 104 (as in FIG. 9), the holes reside in the drain trough 110, and liquids exiting filter 60, such as degreasing composition run off, drain directly into the drain trough 110.

Figure 11:
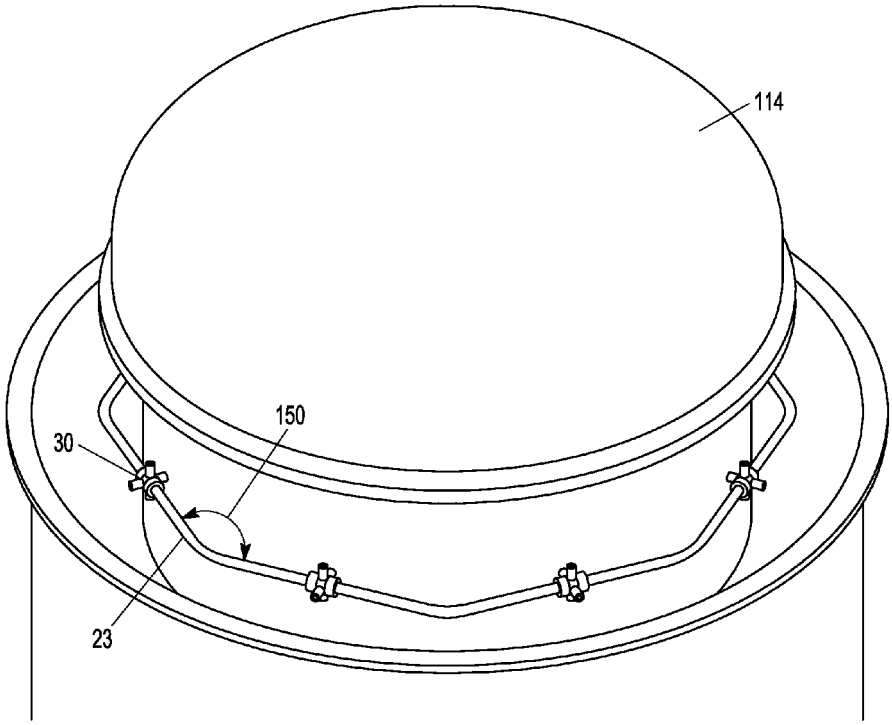
FIG. 11 is a perspective view of a fan subsystem conduit positioned within a fan subsystem according to the principles of one embodiment of the present invention.
Figure 12:
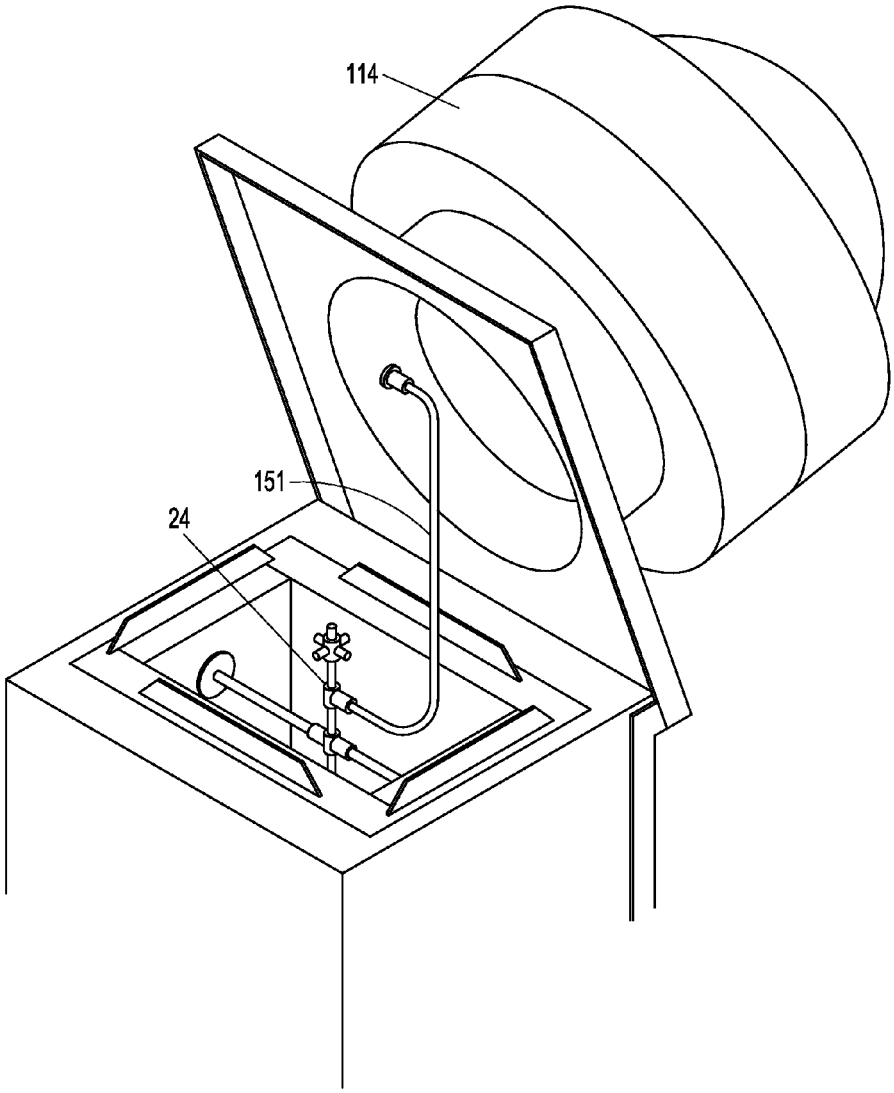
FIG. 12 is a perspective view of a fluid coupling between a flue conduit and a fan subsystem conduit according to the principles of one embodiment of the present invention.

FIGS. 11 and 12 illustrate perspective views of a fan subsystem conduit 23 positioned within a fan subsystem 114 located above a terminating end of a flue spray conduit 24. The fan subsystem conduit 23 can be included in the fluid delivery system 14, in addition to a hood spray conduit 22 (FIG. 1) and a flue spray conduit 24. In the embodiment shown, the fan subsystem conduit 23 extends around the fan subsystem 114 using a plurality of bends, each having an angle 150 greater than 90 degrees. Alternatively, junction piece couplings having an angle greater than 90 degrees can be used. The fan subsystem conduit 23 can include spray nozzles 30 oriented toward interior surfaces of the fan subsystem 114. This orientation can allow the spray nozzles 30 to direct degreasing composition to fan subsystem surfaces. As shown in the embodiment of FIG. 12, the fan subsystem conduit 23 can be fluidly coupled to a flue conduit 24 using a fluid transportation means such as tubing 151.

An advantage of the present invention is the ability to clean a cooking range exhausts periodically and with minimal effort. In addition, the cleaning system 10 can be conveniently retrofit into existing cooking range exhausts or can be integrated with a cooking range exhaust at the time of manufacture or install.

The above Detailed Description includes references to the accompanying drawings, which form a part of the Detailed Description. The drawings show, by way of illustration, specific embodiments in which the present range exhaust cleaning systems and methods can be practiced. These embodiments are also referred to herein as "examples."

The above Detailed Description is intended to be illustrative, and not restrictive. For example, the above-described examples (or one or more elements thereof) can be used in combination with each other. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In the event of inconsistent usages between this document and any document so incorporated by reference, the usage in this document controls.

In this document, the terms "a" or "an" are used to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

In the appended claims, the terms "including" and "in which" are used as the plain-English equivalents of the respective terms "comprising" and "wherein." The terms "including" and "comprising" are open-ended, that is, a system or method that includes elements in addition to those listed after such a term in a claim are still deemed to fall within the scope of that claim. Also, in the following claims, the terms "first," "second," and "third," etc. are used merely as labels, and are not intended to impose numerical requirements on their objects.

The Abstract is provided to allow the reader to quickly ascertain the nature of the technical disclosure. It is submitted with the understanding that it will not be used to interpret or limit the scope or meaning of the claims.

What is claimed is:

1. A cleaning system for a cooking range exhaust including a range hood having a backsplash and optionally an exhaust flue, the cleaning system comprising:

a fluid delivery system constructed for at least partial placement within the cooking range exhaust, the fluid delivery system including, a non-rotating hood spray conduit constructed for placement within the range hood and longitudinally traversing a portion of the backsplash, the hood spray conduit comprising a plurality of spray openings for directing a degreasing composition to an interior surface of the backsplash;

a non-rotating flue spray conduit constructed for placement within or outside the flue, the flue spray conduit comprising or couplable to a plurality of spray openings for directing the degreasing composition to an interior surface of the flue; and a fan subsystem conduit constructed for placement within a fan subsystem located vertically above a top end portion of the flue spray conduit, the fan subsystem conduit comprising a plurality of spray openings for directing the degreasing composition to an interior surface of the fan subsystem, wherein the fan subsystem conduit includes a plurality of bends or couplings, each bend or coupling forming an angle greater than 90 degrees; and a pump system constructed for conveying the degreasing composition from a degreasing composition source and through the fluid delivery system.

2. The cleaning system of claim 1, wherein the non-rotating flue spray conduit is constructed for placement outside the flue and includes a plurality of segments, each segment including an end couplable to another segment or at least one of the plurality of spray openings.

3. The cleaning system of claim 1, wherein the non-rotating flue spray conduit is constructed for placement outside of the flue and includes a plurality of openings along a conduit wall, each opening couplable to at least one of the plurality of spray openings.

4. The cleaning system of claim 1, wherein at least one of the spray openings of the flue spray conduit is configured to vertically spray the degreasing composition into the fan subsystem.

5. The cleaning system of claim 1, wherein the fan subsystem conduit is fluidly couplable to the flue conduit.

6. The cleaning system of claim 1, wherein the fluid delivery system further comprises a first connection conduit connecting the hood spray conduit to the pump system along a first fluid path, and a second connection conduit connecting the flue spray conduit to the pump system along a second fluid path spaced from the first fluid path.

7. The cleaning system of claim 1, wherein each of the spray openings of the hood spray conduit and the flue spray conduit comprise a non-rotary spray nozzle.

8. The cleaning system of claim 1, wherein the fluid delivery system further comprises a non-rotating flue spray conduit constructed for placement outside the flue and comprising at least one spray opening for directing the degreasing composition to an interior surface of the flue.

9. The cleaning system of claim 1, wherein the hood spray conduit includes a plurality of individually actuatable zones, each zone traversing a portion of the backsplash and including at least one spray opening.

10. The cleaning system of claim 1, further comprising a user-interface integrated with the pump system allowing control and programming of the pump system, the user-interface including a memory storing a performance history of the pump system.

11. The cleaning system of claim 1 in combination with a fire prevention system integrated with the cooking range exhaust, and configured to detect and extinguish fires in the cooking range exhaust.

12. The cleaning system of claim 11, wherein the fire prevention system uses the fluid delivery system, and wherein the pump system is constructed for conveying, through the fluid delivery system, the degreasing composition from the degreasing composition source and water from a water source.

* * * * *